US007108492B2

(12) United States Patent
Yamamoto et al.

(10) Patent No.: US 7,108,492 B2
(45) Date of Patent: Sep. 19, 2006

(54) ROOTS PUMP

(75) Inventors: Shinya Yamamoto, Kariya (JP); Mamoru Kuwahara, Kariya (JP); Mika Fujiwara, Kariya (JP); Nobuaki Hoshino, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/848,959

(22) Filed: May 18, 2004

(65) Prior Publication Data

US 2004/0241027 A1 Dec. 2, 2004

(30) Foreign Application Priority Data

May 19, 2003 (JP) ..... 2003-141114

(51) Int. Cl.
*F01C 1/30* (2006.01)
*F03C 2/00* (2006.01)

(52) U.S. Cl. ..... 418/5; 418/9; 418/180

(58) Field of Classification Search ..... 418/5, 418/9, 180, 206.4
See application file for complete search history.

(56) References Cited

U.S. PATENT DOCUMENTS

| | | | | |
|---|---|---|---|---|
| 3,844,695 | A * | 10/1974 | Weatherston | 418/180 |
| 4,652,223 | A * | 3/1987 | Nissen | 418/206.1 |
| 6,176,693 | B1 * | 1/2001 | Conti | 418/180 |

FOREIGN PATENT DOCUMENTS

| | | | |
|---|---|---|---|
| DE | 3318519 | A1 * | 11/1984 |
| EP | 1 006 281 | A1 | 6/2000 |
| EP | 1 150 015 | A2 | 10/2001 |
| EP | 1 201 927 | A2 | 5/2002 |
| GB | 309685 | * | 4/1929 |
| JP | 64-80786 | | 3/1989 |
| JP | 2-91491 | | 3/1990 |
| JP | 05018379 | A * | 1/1993 |
| JP | 10-184576 | | 7/1998 |
| JP | 11-315794 | | 11/1999 |
| JP | 2002-206493 | | 7/2002 |
| JP | 2002-221178 | | 8/2002 |
| JP | 2003-90292 | | 3/2003 |

* cited by examiner

*Primary Examiner*—Theresa Trieu
(74) *Attorney, Agent, or Firm*—Morgan & Finnegan, LLP

(57) ABSTRACT

A roots pump has a housing, a plurality of rotary shafts, a rotor, a confluent passage and a closed space. The housing forms therein a pump chamber. The rotary shafts are supported on the housing in parallel relation to each other. The rotor is mounted on each of the rotary shafts, and the rotors on any adjacent rotary shafts are in engagement with each other. A set of the engaged rotors is accommodated in the pump chamber. The confluent passage is formed along one crossing line of paired imaginary swept peripheral surfaces in one-to-one correspondence with the paired and engaged rotors. The closed space is formed in one-to-one correspondence with each of the paired rotors between the paired rotors and paired peripheral wall surfaces which form the pump chamber. The closed space initially joins the confluent passage from a terminal end thereof with rotation of the paired rotors.

12 Claims, 7 Drawing Sheets

ROOTS PUMP

BACKGROUND OF THE INVENTION

The present invention relates to a roots pump having a plurality of rotary shafts arranged in parallel relation to each other and a rotor arranged on each of the rotary shafts, wherein the rotors on any two adjacent rotary shafts are engaged with each other and a set of engaged rotors are accommodated in a pump chamber which is formed in the roots pump.

In a roots pump, or a kind of vacuum pump, as disclosed in Unexamined Japanese Patent Publication No. 2002-221178, a set of two rotors are rotated in engagement with each other. The rotation of the two engaged rotors transfers gas while simultaneously compressing the same. The roots pump having plural sets of such two rotors has a passage formed in an end wall which partitions any two adjacent pump chambers which are arranged in the axial direction of the rotary shaft for transferring the gas from a large-volume pump chamber to a smaller-volume pump chamber.

The roots pump has a closed space formed between the rotor and a peripheral wall surface of the pump chamber facing the rotor, and such closed space communicates with the other closed space formed between the other rotor and the other peripheral wall surface of the same pump chamber facing the other rotor. The passage in the end wall communicates with this confluent space (a confluent passage in the present invention), and gas in the confluent space flows into the passage in the end wall.

When a roots pump is used as a vacuum pump in a film production process for manufacturing semiconductor, such as process for forming nitriding film, reaction product flows into the roots pump with gas. When this reaction product is accumulated in a pump chamber of the roots pump, operation of the roots pump may become disabled. Therefore, there has been a need for preventing reaction product from being accumulated in a roots pump.

SUMMARY OF THE INVENTION

In accordance with the present invention, a roots pump has a housing, a plurality of rotary shafts, a rotor, a confluent passage and a closed space. The housing forms therein a pump chamber. The rotary shafts are supported on the housing in parallel relation to each other. The rotor is mounted on each of the rotary shafts, and the rotors on any adjacent rotary shafts are in engagement with each other. A set of the engaged rotors is accommodated in the pump chamber. The confluent passage is formed along one crossing line of paired imaginary swept peripheral surfaces in one-to-one correspondence with the paired and engaged rotors. The closed space is formed in one-to-one correspondence with each of the paired rotors between the paired rotors and paired peripheral wall surfaces which form the pump chamber. The closed space initially joins the confluent passage from a terminal end of the confluent passage with rotation of the paired rotors.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first preferred embodiment of a roots pump 10 according to the present invention will now be described with reference to FIGS. 1 through 8B.

Figure 1:
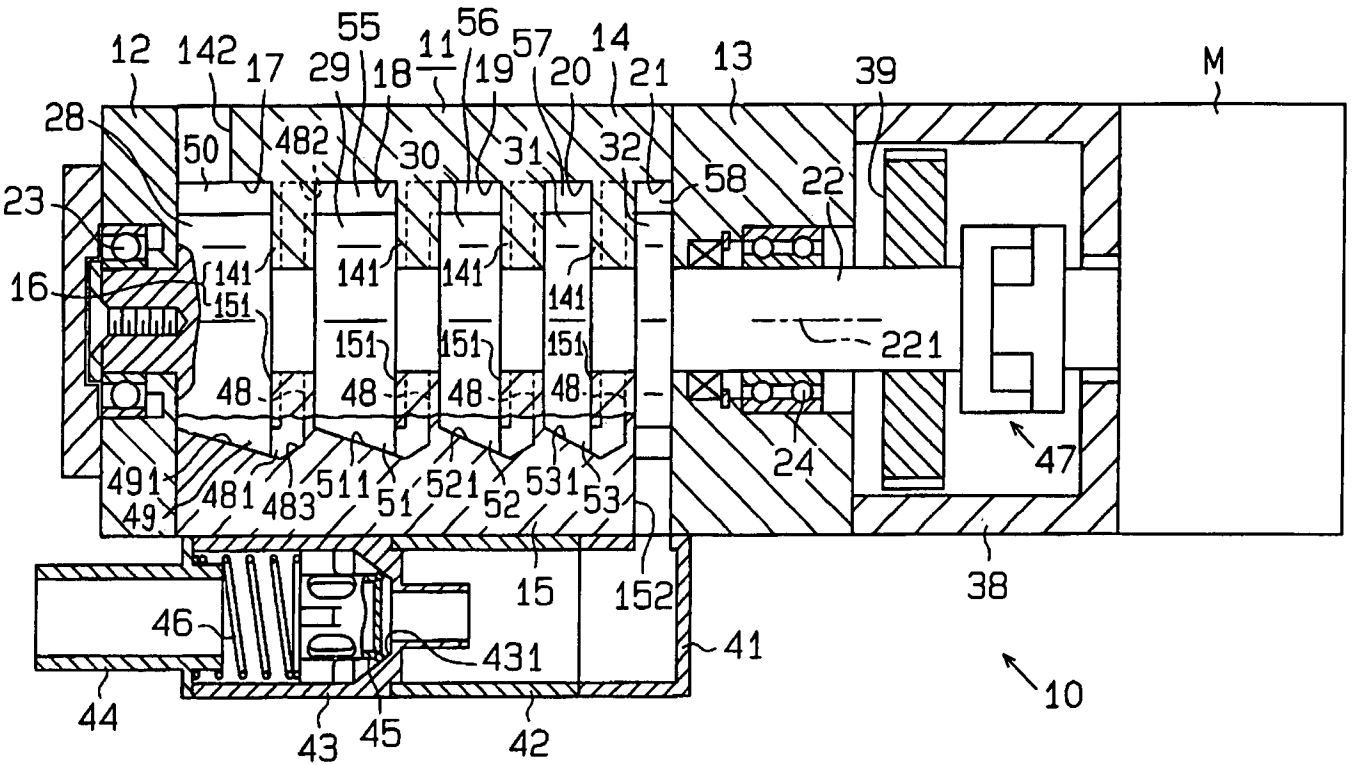
FIG. 1 is a longitudinal cross-sectional view of a whole roots pump according to a first preferred embodiment of the present invention.
Figure 2:
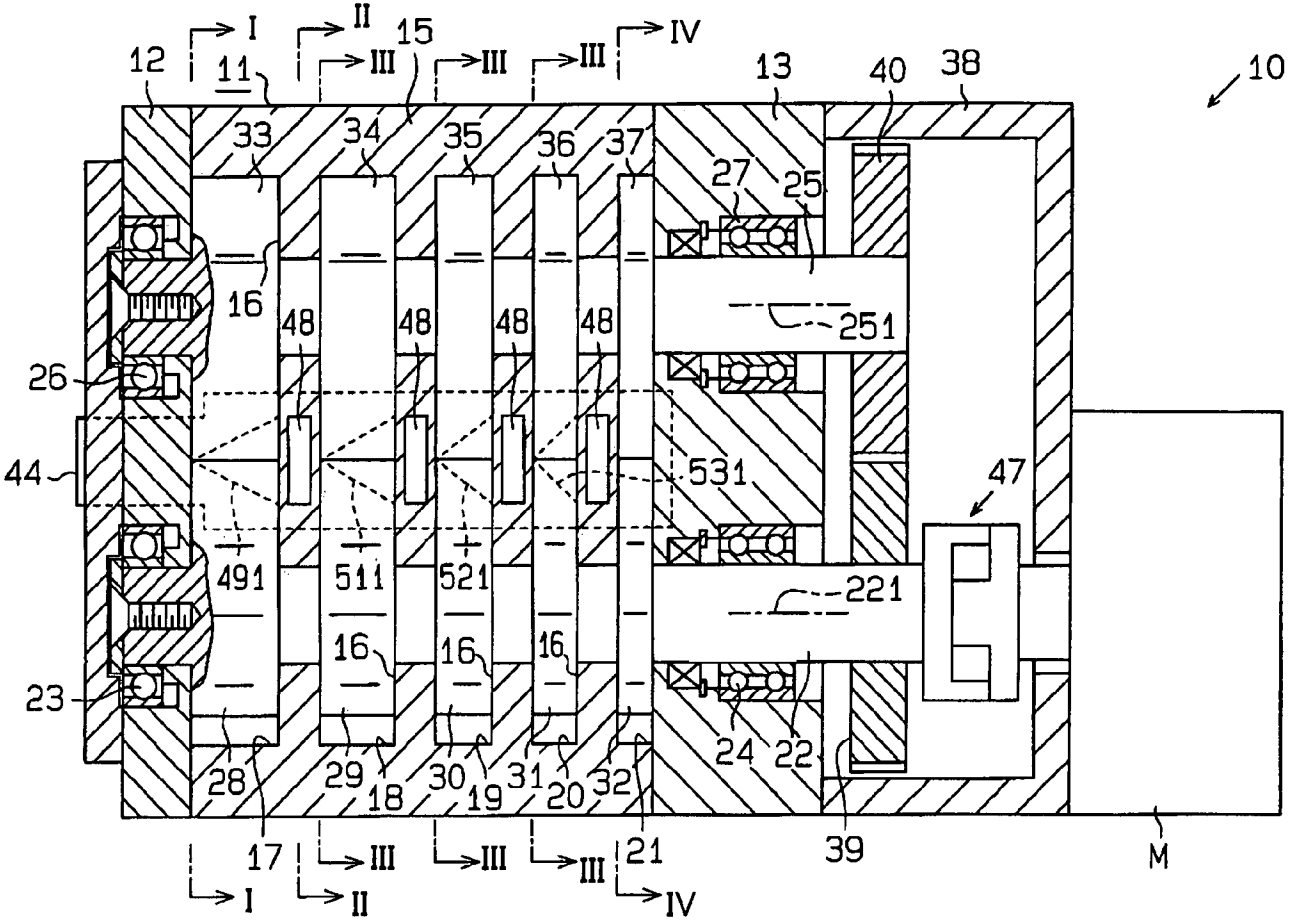
FIG. 2 is a cross-sectional plan view of the whole roots pump according to the first preferred embodiment of the present invention.

Referring to FIGS. 1 and 2, the roots pump or a kind of vacuum pump 10 has a rotor housing 11, a front housing 12 connected to the front end of the rotor housing 11 and a rear housing 13 connected to the rear end of the rotor housing 11. These rotor housing 11, front housing 12 and rear housing 13 cooperate to form the housing of the roots pump 10. It is noted that the upper side and the lower side of FIG. 1 correspond to the upper side and the lower side of the roots pump 10, respectively.

The rotor housing 11 includes a cylinder block 14 forming integrally therewith a plurality of wall elements 141 and a cylinder block 15 forming integrally therewith a plurality of wall elements 151. The wall elements 141, 151 are paired, respectively, and each paired wall elements 141, 151 cooperates to form an end wall 16. A space between the front housing 12 and the end wall 16 and spaces between any two adjacent end walls 16 are defined as pump chambers 17, 18, 19, 20, respectively. A space between the rear housing 13 and the end wall 16 is defined as a pump chamber 21. The pump chambers 17, 18, 19, 20, 21 are formed such that the widths thereof are reduced progressively in this order.

As shown in FIG. 2, the front housing 12 and the rear housing 13 rotatably support a rotary shaft 22 through radial bearings 23, 24, respectively. Similarly, the front housing 12 and the rear housing 13 rotatably support a rotary shaft 25 through radial bearings 26, 27, respectively. The rotary shafts 22, 25 are arranged in parallel relation to each other, extending through the end walls 16.

The rotary shaft 22 has a plurality of rotors 28, 29, 30, 31, 32 formed integrally therewith. Similarly, the rotary shaft 25 has also a plurality of rotors 33, 34, 35, 36, 37 formed integrally therewith. The number of the rotors formed with the rotary shaft 25 is equal to that with the rotary shaft 22. The rotors 28 through 32 have similar shape and size as seen in the direction of the axis 221 of the rotary shaft 22. Similarly, the rotors 33 through 37 have similar shape and size as seen in the direction of the axis 251 of the rotary shaft 25. The thicknesses of the rotors 28, 29, 30, 31, 32 reduce in this order, and the thicknesses of the rotors 33, 34, 35, 36, 37 also reduce in this order.

The rotors 28, 33 are accommodated in the pump chamber 17 in engagement with each other with a slight clearance formed therebetween. The rotors 29, 34 are accommodated in the pump chamber 18 in similar engagement with each other. Similarly, the rotors 30, 35, the rotors 31, 36, and the rotors 32, 37 are accommodated in the pump chamber 19, 20 and 21, respectively. The volumes of the pump chambers 17 through 21 reduce progressively in this order.

The rotors 28, 33 sweep or pass over the surfaces of inner peripheral walls 59, 60, which form the pump chamber 17, at a slight distance therefrom. The rotors 29, 34; 30, 35; 31, 36; and 32, 37 pass similarly over the surfaces of the inner peripheral walls 61, 62; 63, 64; 65, 66 and 67, 68 which form the pump chambers 18, 19, 20 and 21, respectively.

The roots pump 10 further includes a gear housing 38 assembled to the rear housing 13. The rotary shafts 22, 25 extend through the rear housing 13 and protrude into the gear housing 38. Gears 39, 40 are secured to the protruding ends of the rotary shafts 22, 25, respectively, for engagement with each other. An is electric motor M is assembled to the gear housing 38, and driving power of the electric motor M is transmitted to the rotary shaft 22 through a shaft coupling 47 thereby to rotate the rotary shaft 22 in the direction indicated by the arrow R1 in FIGS. 3 through 6. The rotary shaft 25 receives the driving power of the electric motor M through the gears 39, 40 thereby to be rotated in reverse direction of the rotary shaft 22, or in the direction indicated by the arrow R2 in FIGS. 3 through 6.

Figure 3:
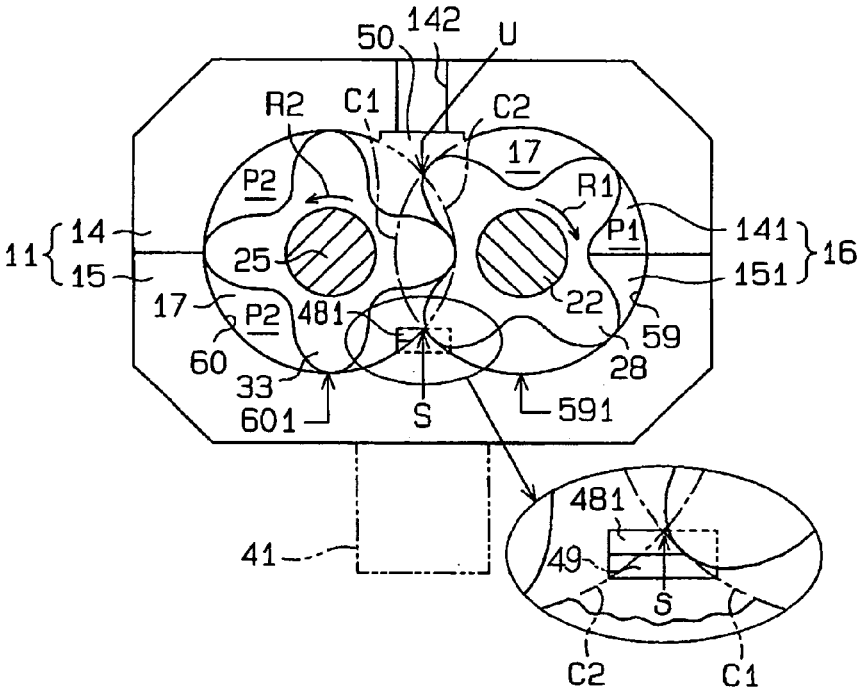
FIG. 3 is a cross-sectional view that is taken along the line I—I in FIG. 2.

A circular arc C1 illustrated in FIG. 3 shows a region of imaginary peripheral surface which is swept by the rotor 28 during its rotation, while a circular arc C2 shows a region of imaginary peripheral surface which is swept by the rotor 33 during its rotation. The imaginary peripheral surfaces indicated by the circular arcs C1, C2 are referred to as swept peripheral surfaces C1, C2 hereinafter. These two circular arcs or swept peripheral surfaces C1, C2 intersect at two points S and U as seen in FIG. 3 (actually S and U being imaginary crossing lines extending perpendicularly to the plane of the drawing of FIG. 3 and one of such imaginary lines S being shown in FIG. 7.) The pump chamber 17 forms therein a confluent passage 49 which extends along the crossing line S. The confluent passage 49 is located at a region which is adjacent to the crossing line S and surrounded by the swept peripheral surfaces C1, C2 and the peripheral wall surface which forms the pump chamber 17. The pump chamber 17 also forms therein a splitting passage 50 which extends along the other side of the intersections, which is denoted by U. The splitting passage 50 is located at a region which is adjacent to the crossing line U and surrounded by the swept peripheral surfaces C1, C2 and the peripheral wall surface which forms the pump chamber 17.

Figure 5:
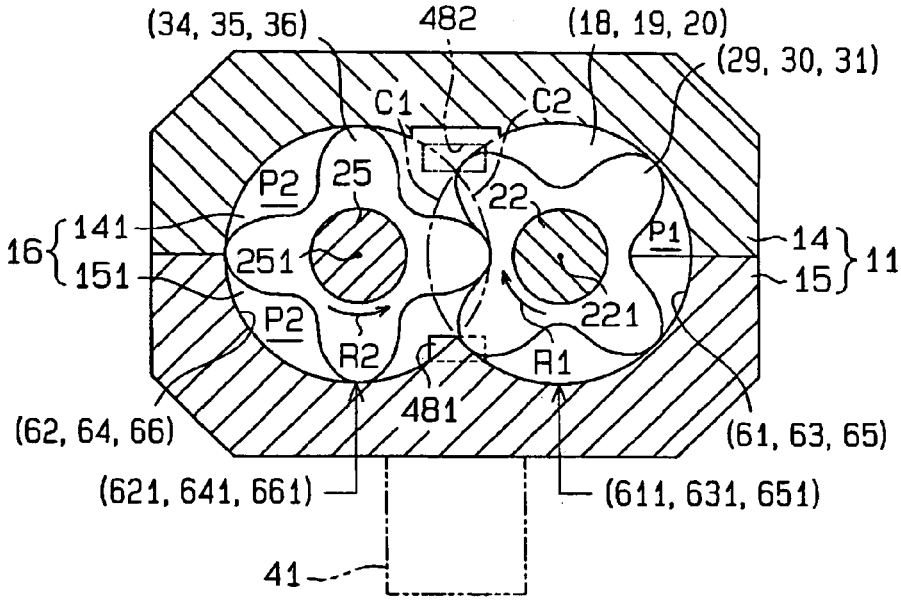
FIG. 5 is a cross-sectional view that is taken along the line III—III in FIG. 2.
Figure 6:
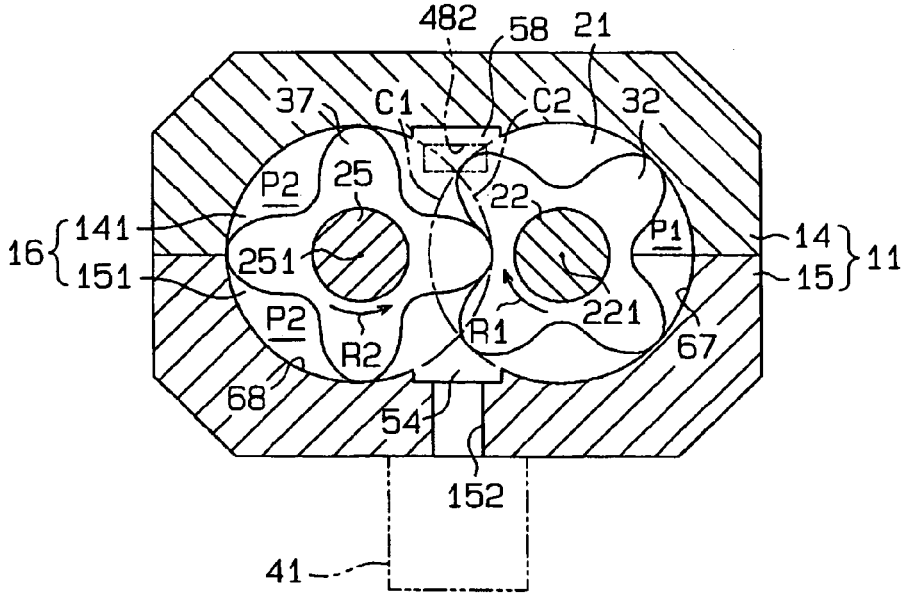
FIG. 6 is a cross-sectional view that is taken along the line IV—IV in FIG. 2.

As shown in FIGS. 1 and 6, the pump chambers 18 through 21 also forms therein confluent passages 51, 52, 53, 54, and also splitting passages 55, 56, 57, 58, respectively. As in the case of the pump chamber 17, the swept peripheral surfaces C1, C2 are illustrated in the pump chambers 18 through 21, as shown in FIGS. 5 and 6.

As shown in FIG. 1, a passage surface 491 of the confluent passage 49 has a planar shape and an inclined plane which declines from the side of the front housing 12 toward the side of the rear housing 13. Similarly, passage surfaces 511, 521, 531 of the confluent passages 51, 52, 53 also have a planar shape and inclined planes which decline from the side of the front housing 12 toward the side of the rear housing 13, respectively.

Figure 8A:
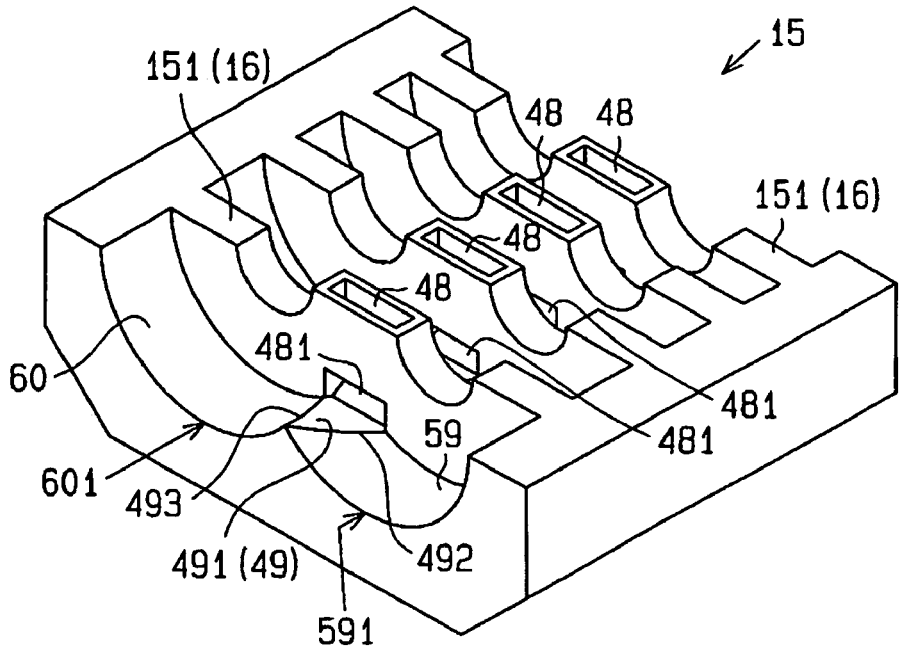
FIG. 8A is a schematic perspective view of a cylinder block according to the first preferred embodiment of the present invention.
Figure 8B:
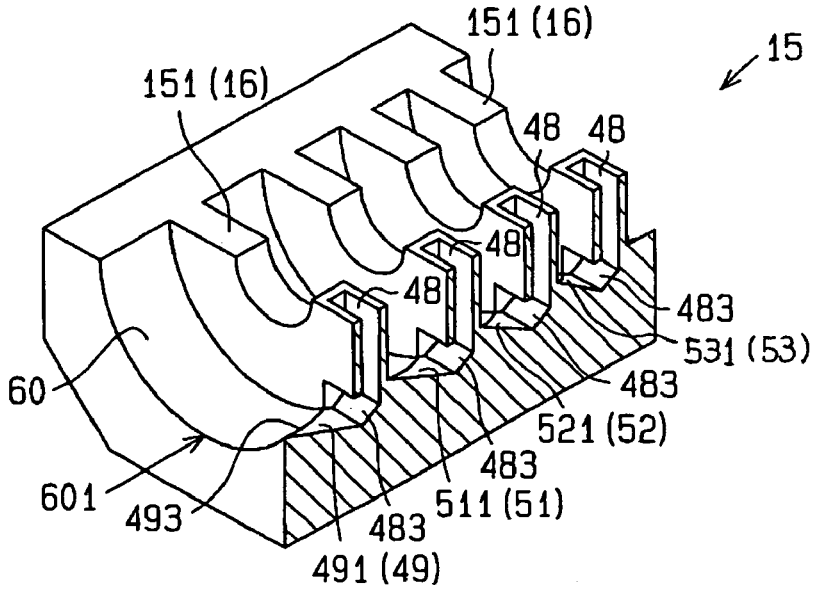
FIG. 8B is a schematic perspective view of the cylinder block with partially cut away according to the first preferred embodiment of the present invention.

FIGS. 8A and 8B show the passage surfaces 491, 511, 521, 531 of the confluent passages 49, 51, 52, 53, respectively. The passage surface 491 is located higher than the lowest portion 591 of the peripheral wall surface 59 corresponding to the rotor 28 and is also located higher than the lowest portion 601 of the peripheral wall surface 60 corresponding to the rotor 33. Similarly, the passage surface 511 is located higher than the lowest portion 611 of the peripheral wall surface 61 corresponding to the rotor 29 and is also located higher than the lowest portion 621 of the peripheral wall surface 62 corresponding to the rotor 34. The passage surface 521 is located higher than the lowest portion 631 of the peripheral wall surface 63 corresponding to the rotor 30 and is also located higher than the lowest portion 641 of the peripheral wall surface 64 corresponding to the rotor 35. The passage surface 531 is located higher than the lowest portion 651 of the peripheral wall surface 65 corresponding to the rotor 31 and is also located higher than the lowest portion 661 of the peripheral wall surface 66 corresponding to the rotor 36. The passage surfaces 491, 511, 521, 531 of the confluent passages 49, 51, 52, 53 form part of the wall surfaces which form the pump chambers 17, 18, 19, 20, respectively.

The passage surfaces 491, 511, 521, 531 of the respective confluent passages 49, 51, 52, 53 connect with the peripheral wall surfaces 59 through 66, respectively. Side edges 492, 493 of the passage surface 491 are connections between the passage surface 491 of the confluent passage 49 and the peripheral wall surfaces 59, 60, respectively. The planar passage surface 491 declines from the side of the front housing 12 toward the side of the rear housing 13 and is also located higher than the lowest portions 591, 601 of the peripheral wall surfaces 59, 60. Accordingly, the side edges 492, 493 of the passage surface 491 are spaced apart from each other increasingly from the side of the front housing 12 toward is the side of the rear housing 13. In other words, the width of the confluent passage 49, that is, the width of the passage surface 491, is widened progressively from the side of the front housing 12 toward the side of the rear housing 13, and the width of the confluent passage 49 at its terminal end 495 is greater than that at the starting end 494. Similarly, the widths of the confluent passages 51 through 53, that is, the widths of the passage surfaces 511 through 531, are also widened increasingly from the side of the front housing 12 toward the side of the rear housing 13.

Figure 4:
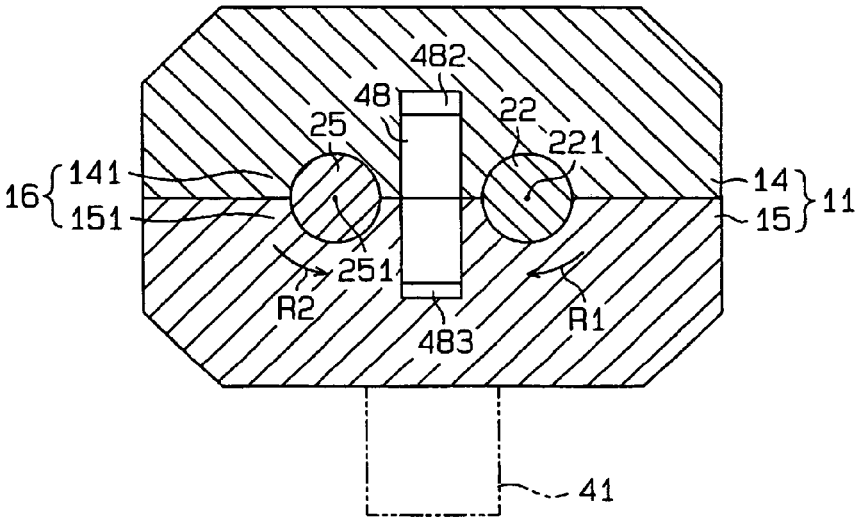
FIG. 4 is a cross-sectional view that is taken along the line II—II in FIG. 2.

As shown in FIGS. 1 and 4, the end wall 16 forms therein a passage 48. The end wall 16 also forms therein an inlet 481 and an outlet 482 of the passage 48. The confluent passages 49, 51, 52, 53 communicate with the inlets 481 of the passages 48, respectively, and any two adjacent pump chambers 17, 18, 19, 20, 21 are in communication with each other through the passage 48 in the end wall 16, respectively. Each passage 48 has an inclined surface 483 formed at its bottom. The inclined surface 483 declines from the side of the rear housing 13 toward the side of the front housing 12. The inclined surface 483 of the passage 48 connecting with the confluent passage 49 continues into the passage surface 491 of the confluent passage 49. Similarly, the inclined surface 483 of the exhaust passage 48 connecting with the confluent passage 51 continues into the passage surface 511 of the confluent passage 51. The inclined surface 483 of the exhaust passage 48 connecting with the confluent passage 52 continues into the passage surface 521 of the confluent passage 52. The inclined surface 483 of the exhaust passage 48 connecting with the confluent passage 53 continues into the passage surface 531 of the confluent passage 53.

A closed space P1 is formed between the rotor 28 and the peripheral wall surface 59 which forms the pump chamber 17, and a closed space P2 is formed between the rotor 28 and the peripheral wall surface 60 which forms the pump chamber 17 and the rotor 33. The closed spaces P1, P2 moving from the splitting passage 50 toward the confluent passage 49 with rotation of the rotors 28, 33 meet each other at the confluent passage 49. Likewise, similar closed spaces are formed in the other pump chambers 18 through 21, as indicated by P1, P2 in FIGS. 5 and 6.

As shown in FIGS. 1 and 3, the cylinder block 14 forms therein a suction port 142 which communicates with the splitting passage 50 of the pump chamber 17. As shown in FIGS. 1 and 6, the cylinder block 15 forms therein an exhaust port 152 which communicates with the confluent passage 54 of the pump chamber 21.

As shown in FIG. 1, a flange 41 is connected to the exhaust port 152. A muffler 42 is connected to the flange 41, and a guide pipe 43 is connected to the muffler 42. Furthermore, an exhaust pipe 44 is connected to the guide pipe 43. The exhaust pipe 44 is connected to an exhaust gas treatment device (not shown).

The guide pipe 43 accommodates therein a valve body 45 and a return spring 46. The guide pipe 43 forms therein a tapered valve hole 431, and the valve body 45 is operable to open and close the valve hole 431. The return spring 46 urges the valve body 45 in the direction which causes the valve hole 431 to be closed. The guide pipe 43, the valve body 45 and the return spring 46 cooperatively serve as a means for preventing reverse flow of gas.

As the electric motor M of the roots pump 10 initiates operation, the rotary shafts 22, 25 rotate and, therefore, gas in an external vacuum target region (not shown) is introduced into the pump chamber 17 through the suction port 142. The gas introduced into the splitting passage 50 of the pump chamber 17 through the suction port 142 is taken into the closed spaces P1, P2 and then transferred toward the confluent passage 49 by rotation of the rotors 28, 33. The gas sent to the confluent passage 49 flows from the inlet 481 of the end wall 16 into the exhaust passage 48 and then transferred to the splitting passage 55 of the next (or downstream) pump chamber 18 through the outlet 482. Similarly, the gas is transferred from one pump chamber to another in the order in which the volume of the pump chambers reduce, that is, in the order of the pump chambers 18, 19, 20, 21. In other words, the gas introduced into the pump chamber 17 is transferred therefrom to the pump chambers 18 through 21 one after another while being compressed. The gas transferred into the pump chamber 21 is then exhausted to the exhaust gas treatment device through the exhaust port 152, the flange 41, the muffler 42 and the backflow preventing means.

Figure 7:
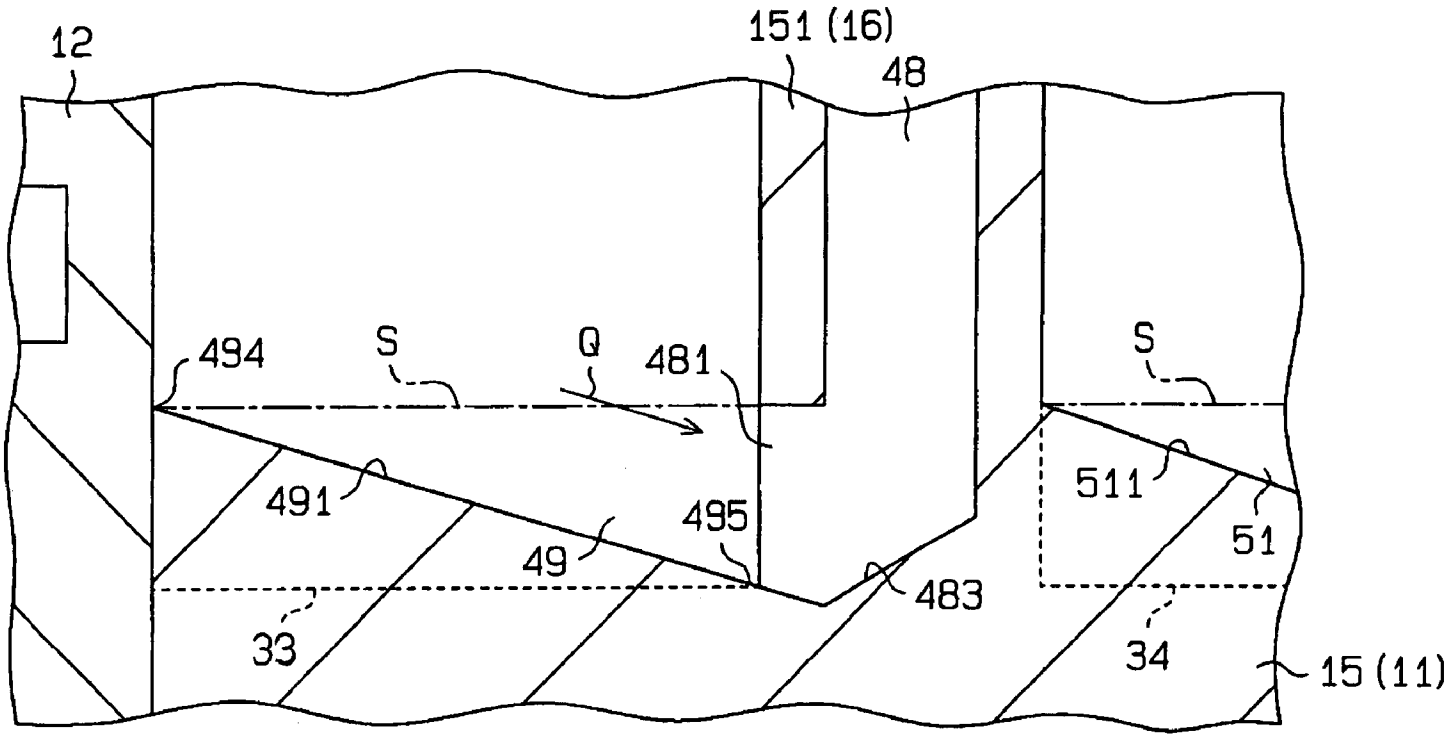
FIG. 7 is a partially enlarged schematic cross-sectional view of FIG. 1.

Each of the confluent passages 49, 51, 52, 53 has a front end on the side of the front housing 12 and a rear end on the side of the rear housing 13, as represented by the starting end 494 and the terminal end 495 of the confluent passage 49 as shown in FIG. 7. The inlets 481 of the passages 48 in the end walls 16 continue into the confluent passages 49, 51, 52, 53, respectively. In other words, the rear ends of the confluent passages 49, 51, 52, 53 correspond to the communication sides of the passages 48 of the pump chambers 17 thorough 20.

According to the first preferred embodiment, the following advantageous effects are obtained. It is noted that the effects will be mentioned with reference to only the confluent passage 49, but similar effects are obtainable from the other confluent passages 49, 51, 52, 53.

(1-1) The gas introduced into the splitting passage 50 is taken into the closed spaces P1, P2 and transferred toward the confluent passage 49 with the rotation of the rotors 28, 33. Since the planar passage surface 491 of the confluent passage 49 declines from the side of the front housing 12 toward the side of the rear housing 13, meeting of the gases in the spaces P1, P2 takes place firstly at the terminal end 495 of the confluent passage 49. That is, a communication port between the closed spaces P1, P2 and the confluent passage 49 is opened from the side of the terminal end 495 of the confluent passage 49.

If the meeting of the closed spaces P1, P2 takes place simultaneously at both the starting end 494 and the terminal end 495 of the confluent passage 49, the gas in the closed spaces P1, P2 simultaneously flows into the confluent passage 49 from both the starting end 494 and the terminal end 495 of the confluent passage 49. Such inflow tends to cause stagnation of the gas adjacent to the starting end 494 of the confluent passage 49 and, therefore, reaction product tends to be accumulated at the point of stagnation when the roots pump 10 is used as a vacuum pump in film production process for manufacturing semiconductors.

When the closed spaces P1, P2 join the confluent passage 49 from the terminal end 495 toward the opposite starting end 494 of the confluent passage 49, the gas in the closed spaces P1, P2 flows initially at the terminal end 495 and then to the confluent passage 49. As the closed spaces P1, P2 move toward the confluent passage 49 by further rotation of the rotors 28, 33, the communication port between the closed spaces P1, P2 and the confluent passage 49 expands from the terminal end 495 toward the starting end 494. As a result, a gas flow as is indicated by the arrow Q in FIG. 7 occurs in the confluent passage 49. The gas flow along the confluent passage 49 helps eliminate stagnation adjacent to the starting end 494 of the confluent passage 49 thereby to solve the problem that reaction product tends to be accumulated near the starting end 494 of the confluent passage 49.

(1-2) According to the first preferred embodiment, the planar passage surface 491 declines from the starting end 494 of the confluent passage 49 toward the terminal end 495 thereof.

In such declined passage structure, the side edges 492, 493 of the passage surface 491 extend from the starting end 494 of the confluent passage 49 toward the terminal end 495 thereof while being spaced further away from the crossing line S. Therefore, the closed space P1 on the side of the rotor 28 and the closed space P2 on the side of the rotor 33 initiate to join the confluent passage 49 from the terminal end 495 of the confluent passage 49. In such structure that the planar passage surface 491 of the confluent passage 49 declines from the starting end 494 of the confluent passage 49 toward the terminal end 495 thereof, the closed spaces P1, P2 initiate to join the confluent passage 49 favorably from the terminal end 495 of the confluent passage 49.

(1-3) In the first preferred embodiment, the confluent passage 49 is formed along the lower one S of the two crossing lines formed by the paired swept peripheral surfaces C1, C2, while the splitting passage 50 is formed along the upper crossing line U. That is, the confluent passage 49 is arranged below the splitting passage 50. The gas in the splitting passage 50 is taken into the closed spaces P1, P2 with the rotation of the paired rotors 28, 33. In summary, the gas in the splitting passage 50 is transferred downward to the confluent passage 49 through the closed spaces P1, P2, and reaction product in the splitting passage 50 is also transferred downward to the confluent passage 49 through the closed spaces P1, P2. Thus, the transfer of the reaction product is smoothly performed.

Then, according to the first preferred embodiment, the passage surface 491 of the confluent passage 49 located below the splitting passage 50 declines from the starting end 494 of the confluent passage 49 toward the terminal end 495 thereof. Therefore, reaction product tends to be transferred easily by its own weight from the starting end 494 toward the terminal end 495 on the passage surface 491 of the confluent passage 49. The structure wherein the confluent passage 49 having an arrangement for preventing the accumulation of reaction product is located below the splitting passage 50 is effective to eliminate the problem associated with the accumulation of the reaction product in the roots pump 10.

(1-4) The roots pump 10 is a multi-stage type which includes a plurality of the pump chambers 17 through 21 arranged in the direction of the axes 221, 251 of the rotary shafts 22, 25, respectively. In such multi-stage roots pump 10, the exhaust passage 48 is formed in the end wall 16 for transferring gas from one pump chamber to its adjacent pump chamber, and the terminal end 495 of the confluent passage 49 extending in the direction of the axes 221, 251 of the rotary shafts 22, 25 needs be connected to the exhaust passage 48. Therefore, stagnation tends to occur particularly near the starting end 494 of the confluent passage 49 in the multi-stage roots pump 20. Thus, the multi-stage roots pump 10 is appropriate for application of the present invention.

(1-5) The inclined surface 483 provided below the exhaust passage 48 helps the gas flow smoothly thereby to contribute to preventing accumulation of reaction product.

The present invention is not limited to the embodiment described above but may be modified into the following alternative embodiments.

Figure 9:
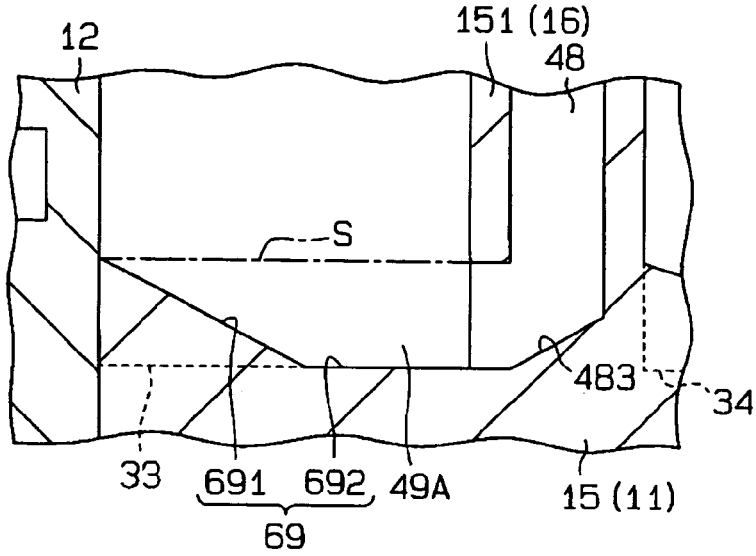
FIG. 9 is a partially enlarged schematic cross-sectional view of a roots pump according to a second preferred embodiment of the present invention.

(1) According to a second preferred embodiment as shown in FIG. 9, a confluent passage 49A having a passage surface 69 is formed, wherein a passage surface 69 includes an inclined surface 691 and a horizontal surface 692. The inclined surface 691 is located adjacent to the starting end of the confluent passage 49A, while the horizontal surface 692 is located adjacent to the terminal end of the confluent passage 49A. In this case, a closed space initiates to join the confluent passage 49A from the side of the horizontal surface 692.

Figure 10:
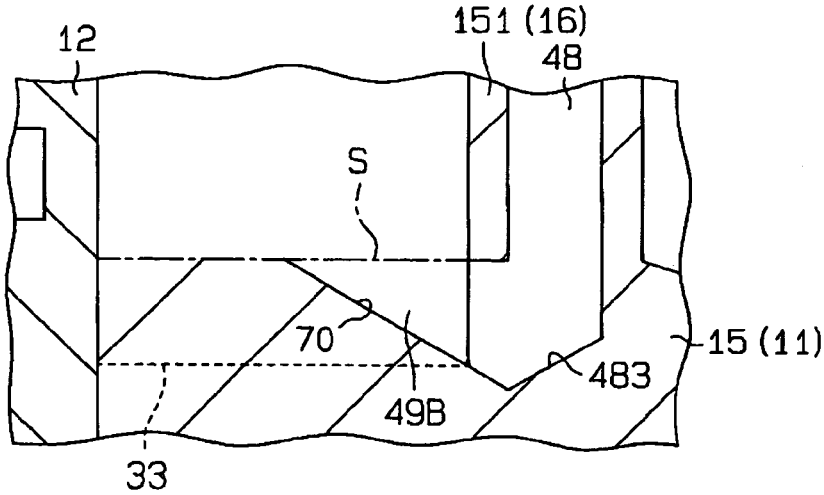
FIG. 10 is a partially enlarged schematic cross-sectional view of a roots pump according to a third preferred embodiment of the present invention.

(2) According to a third preferred embodiment as shown in FIG. 10, a confluent passage 49B is formed such that an inclined passage surface 70 extends from the middle of the crossing line S.

(3) In an alternative embodiment, the confluent passage forms a curved passage surface.

(4) In an alternative embodiment, the confluent passage having an inclined passage surface is provided for only part of the pump chambers, for example, for the pump chamber 17 having the largest width dimension, while the confluent passage having a horizontal passage surface is provided for the other pump chambers 18 through 21.

(5) In the first preferred embodiment, the confluent passage is formed such that, when the closed spaces P1, P2 join the confluent passage 49, one of the closed spaces P1, P2 initiates to join from the terminal end 495 of the confluent passage 49.

(6) The present invention may be applied to a roots pump having only a single pump chamber.

(7) In an alternative embodiment, the inclined surface 483 is modified so that it is a horizontal surface.

(8) In an alternative embodiment, the inclined surface 483 is modified so that it is a curved surface.

(9) The present invention may be applied to a roots pump wherein the splitting passage is provided below the confluent passage.

Therefore, the present examples and embodiments are to be considered as illustrative and not restrictive, and the invention is not to be limited to the details given herein but may be modified within the scope of the appended claims.

What is claimed is:

1. A roots pump comprising:

a housing forming therein a pump chamber;

a plurality of rotary shafts supported on the housing in parallel relation to each other;

a rotor mounted on each of the rotary shafts, the rotors on any adjacent rotary shafts being in engagement with each other, a set of the engaged rotors being accommodated in the pump chamber;

a confluent passage formed along one crossing line of paired imaginary swept peripheral surfaces in one-to-one correspondence with the paired and engaged rotors; and a closed space formed in one-to-one correspondence with each of the paired rotors between the paired rotors and paired peripheral wall surfaces which form the pump chamber, wherein the closed space initially joins the confluent passage from a terminal end of the confluent passage with rotation of the paired rotors.

2. The roots pump according to claim 1, further comprising:

an end wall which forms a part of the pump chamber and also therein a passage, wherein the confluent passage is connected to an inlet of the passage.

3. The roots pump according to claim 1, wherein the terminal end of the confluent passage is wider than a starting end of the confluent passage.

4. The roots pump according to claim 3, wherein side edges of the confluent passage are spaced away from the crossing line from the starting end of the confluent passage toward the terminal end of the confluent passage.

5. The roots pump according to claim 1, wherein the confluent passage has a planar passage surface which declines from the starting end of the confluent passage toward the terminal end of the confluent passage.

6. The roots pump according to claim 1, further comprising:

a splitting passage formed along the other crossing line of the swept peripheral surfaces which are in one-to-one correspondence with the paired rotors, wherein the splitting passage is located above the confluent passage.

7. The roots pump according to claim 1, wherein a plurality of the pump chambers is arranged in an axial direction of the rotary shafts.

8. The roots pump according to claim 1, wherein the confluent passage is formed in a pump chamber other than the pump chamber having a smallest volume.

9. The roots pump according to claim 1, wherein the confluent passage has a passage surface including an inclined surface and a horizontal surface.

10. The roots pump according to claim 9, wherein the inclined surface is located adjacent to a starting end of the confluent passage, while the horizontal surface is located adjacent to the terminal end of the confluent passage.

11. The roots pump according to claim 1, wherein an inclined passage surface of the confluent passage extends from a middle of the crossing line.

12. The roots pump according to claim 1, wherein the roots pump is of multi-stage type.

* * * * *

UNITED STATES PATENT AND TRADEMARK OFFICE

CERTIFICATE OF CORRECTION

PATENT NO. : 7,108,492 B2
APPLICATION NO. : 10/848959
DATED : September 19, 2006
INVENTOR(S) : Shinya Yamamoto et al.

It is certified that error appears in the above-identified patent and that said Letters Patent is hereby corrected as shown below:

At column 4, line 46, please delete “toward is the side” and insert therefor --toward the side--; and At column 6, line 43, please delete “gas flow as is indicated” and insert therefor --gas flow as indicated--.

Signed and Sealed this

Fifteenth Day of July, 2008

JON W. DUDAS
*Director of the United States Patent and Trademark Office*